US010716175B2

(12) United States Patent
Hoogland et al.

(10) Patent No.: US 10,716,175 B2
(45) Date of Patent: Jul. 14, 2020

(54) ACCESSORY STRUCTURES FOR MICROWAVE MOUNTED IN AIRCRAFT GALLEY

(71) Applicant: Rockwell Collins, Inc., Cedar Rapids, IA (US)

(72) Inventors: Frank Hoogland, Nieuwegein (NL); Robin Hoegee, Nieuwegein (NL); Jorge Pacheco, Nieuwegein (NL); Dana R. Smrekar, Nieuwegein (NL)

(73) Assignee: Rockwell Collins, Inc., Cedar Rapids, IA (US)

( * ) Notice: Subject to any disclaimer, the term of this patent is extended or adjusted under 35 U.S.C. 154(b) by 331 days.

(21) Appl. No.: 15/694,212

(22) Filed: Sep. 1, 2017

(65) Prior Publication Data

US 2018/0288837 A1 Oct. 4, 2018

Related U.S. Application Data

(60) Provisional application No. 62/481,557, filed on Apr. 4, 2017.

(51) Int. Cl.
*H05B 6/76* (2006.01)
*F24C 7/02* (2006.01)

(52) U.S. Cl.
CPC ..... *H05B 6/763* (2013.01)

(58) Field of Classification Search
CPC ..... H05B 6/763; H05B 6/6414; H05B 6/766
USPC ..... 219/742, 743, 738, 739, 744, 747, 748, 219/750, 746, 749; 174/374, 377, 382, 174/385
See application file for complete search history.

(56) References Cited

U.S. PATENT DOCUMENTS 4,700,034 A * 10/1987 Lee ..... H05B 6/763 174/377

FOREIGN PATENT DOCUMENTS

JP 04242097 A * 8/1992 ..... H05B 6/763

* cited by examiner

*Primary Examiner* — Quang T Van
(74) *Attorney, Agent, or Firm* — Suiter Swantz pc llo

(57) ABSTRACT

A door assembly for a microwave oven includes a door covering an opening of an oven housing. The door includes a bezel forming an outer frame to conceal internal door components and an inner door portion within the bezel made of a transparent material. An electromagnetic interference (EMI) attenuation device positioned around outer edges of the door includes folded transformer sections with dimensions based on an operative wavelength of electromagnetic energy generated by the oven. The EMI attenuation device attenuates EMI waves escaping the oven through a gap between the housing and the door. The transformer sections are positioned at an incline angle from a horizontal plane in which the transformer sections extend a greater distance in the horizontal plane than in a vertical plane to allow for a reduced bezel size and an increased area of the inner door portion.

20 Claims, 8 Drawing Sheets

ACCESSORY STRUCTURES FOR MICROWAVE MOUNTED IN AIRCRAFT GALLEY

RELATED APPLICATIONS

This application claims priority to U.S. Provisional Patent Application Ser. No. 62/481,557 entitled "Accessory Structures for Microwave Mounted in Aircraft Galley" and filed Apr. 4, 2017, hereby incorporated by reference in its entirety.

BACKGROUND

A major challenge associated with design of a microwave oven is keeping the electromagnetic energy (EMI) contained within the oven cavity where the food is prepared without leaking out into exterior spaces surrounding the oven cavity through openings, gaps in the seal, and through the materials that form the boundaries of the oven cavity.

The most difficult area of the oven cavity to seal off is the, always present, gap between oven door and cavity. To stop energy from leaking through this gap a so called 'choke' is commonly used. This choke is basically a folded section quarter wave transformer that reflects and dampens any EMI trapped inside the choke.

The physical dimensions of the choke are dictated by the frequency of the radiation to be contained. Ideally the depth of the choke is equal to a quarter of the wavelength (214) of the radiation to be contained. For example, for a frequency of 2.45 Gigahertz (GHz), the ideal choke depth is 30.6 millimeters (mm). In many implementations of household microwave ovens, chokes are generally vertically oriented inside a plane of a door to the oven cavity, which helps minimize a thickness of the door. In addition, some household microwave ovens also use chokes having a depth of less than ($\lambda/4$) to further save space.

However, to achieve high levels of EMI shielding required by recent commercial airline standards, the choke for aircraft microwaves cannot have a depth of less than ($\lambda/4$), which results in the chokes for aircraft microwave ovens being larger than household microwave ovens. In addition, the bezel for the aircraft microwave oven doors that forms a counter-shape for the larger, vertically-oriented choke is significantly bigger than bezels for household microwave ovens with smaller, thinner chokes, which severely restricts the size of a door opening for the microwave oven cavity.

SUMMARY OF ILLUSTRATIVE EMBODIMENTS

The forgoing general description of the illustrative implementations and the following detailed description thereof are merely exemplary aspects of the teachings of this disclosure, and are not restrictive.

In certain embodiments, a door assembly for an aircraft galley microwave oven may include a door that covers an opening at a front end of an oven housing to provide access to an interior of the oven. The door may include a bezel that forms an outer frame for the door and conceals internal door components from view outside the oven and an inner door portion within the bezel that may be made of a transparent material and has an area corresponding to an area of the opening at the front end of the oven housing.

In certain embodiments, an electromagnetic interference (EMI) attenuation device surrounding one or more outer edges of the door may include folded transformer sections with dimensions based on an operative wavelength of electromagnetic energy generated by the oven. The EMI attenuation device may attenuate EMI waves escaping to an external environment from the interior of the oven through a gap between the oven housing and the door. Each of the transformer sections may be positioned at an incline angle from a horizontal plane where each of the transformer sections may extend a greater distance in the horizontal plane than in a vertical plane to allow for a reduced bezel size and an increased area of the inner door portion than for a door having vertically-oriented folded transformer sections.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and may or may not represent actual or preferred values or dimensions. Where applicable, some or all features may not be illustrated to assist in the description of underlying features. In the drawings.

DETAILED DESCRIPTION OF ILLUSTRATIVE EMBODIMENTS

Figure 1B:
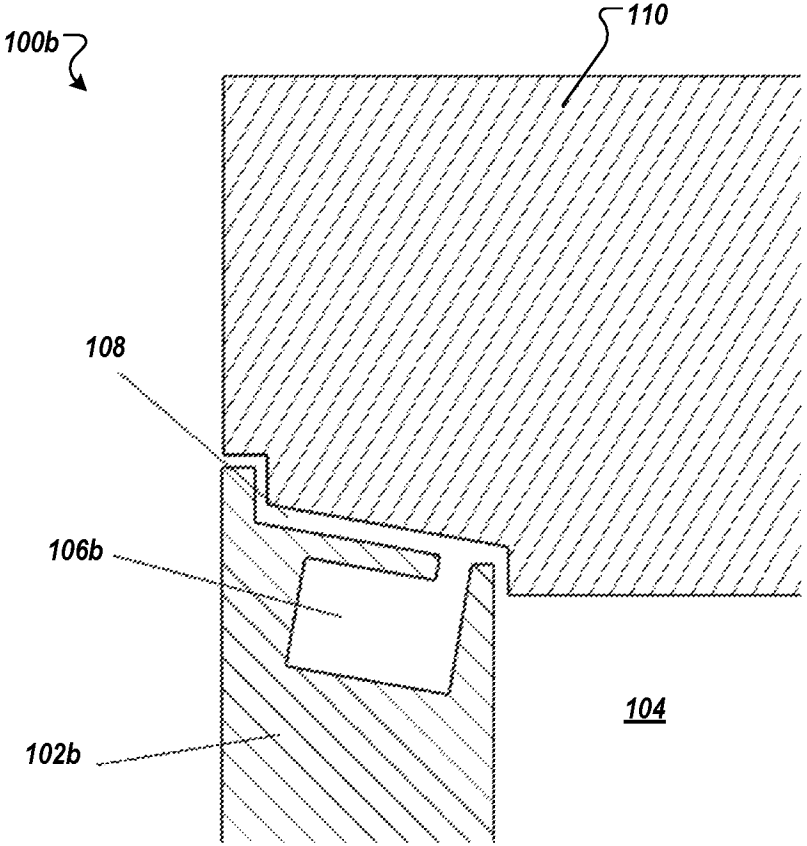
FIGS. 1A-1B illustrate cutaway views of a portion of a door and oven cavity for an example aircraft microwave oven including a choke disposed within a surface of a door to oven cavity.

The description set forth below in connection with the appended drawings is intended to be a description of various, illustrative embodiments of the disclosed subject matter. Specific features and functionalities are described in connection with each illustrative embodiment; however, it will be apparent to those skilled in the art that the disclosed embodiments may be practiced without each of those specific features and functionalities.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments. Further, it is intended that embodiments of the disclosed subject matter cover modifications and variations thereof.

It must be noted that, as used in the specification and the appended claims, the singular forms "a," "an," and "the" include plural referents unless the context expressly dictates otherwise. That is, unless expressly specified otherwise, as used herein the words "a," "an," "the," and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein merely describe points of reference and do not necessarily limit embodiments of the present disclosure to any particular orientation or configuration. Furthermore, terms such as "first," "second," "third," etc., merely identify one of a number of portions, components, steps, operations, functions, and/or points of reference as disclosed herein, and likewise do not necessarily limit embodiments of the present disclosure to any particular configuration or orientation.

Furthermore, the terms "approximately," "about," "proximate," "minor variation," and similar terms generally refer to ranges that include the identified value within a margin of 20%, 10% or preferably 5% in certain embodiments, and any values therebetween.

All of the functionalities described in connection with one embodiment are intended to be applicable to the additional embodiments described below except where expressly stated or where the feature or function is incompatible with the additional embodiments. For example, where a given feature or function is expressly described in connection with one embodiment but not expressly mentioned in connection with an alternative embodiment, it should be understood that the inventors intend that that feature or function may be deployed, utilized or implemented in connection with the alternative embodiment unless the feature or function is incompatible with the alternative embodiment.

Aspects of the present disclosure may be directed to accessory structures for an aircraft microwave oven that may provide electromagnetic shielding and reduce an amount of electromagnetic radiation that can escape from gaps or openings in the microwave oven. For example, one aspect of the present disclosure may be directed to a design for a choke disposed on a surface of a door that covers an opening to a microwave oven cavity for a microwave in which the choke is oriented at an angle that is slightly inclined from the horizontal plane of the door. Oriented the choke at an angle that is slightly inclined from the horizontal plane instead of a vertically-oriented choke allows a choke for an aircraft microwave oven that is physically larger and provides enough shielding to meet aircraft electromagnetic interference (EMI) shielding requirements while still providing a large door opening to a microwave oven cavity.

In another aspect of the present disclosure, a window on a front door of the microwave oven may include a see-through electromagnetic shield or barrier made of a thin photo etched metallic sheet with perforated holes distributed across a surface of the metallic sheet in a predetermined pattern. The electromagnetic barrier may be substantially transparent to allow for viewing the contents of the microwave oven during use while still providing adequate shielding in a high intensity radiated field (HIRF) environment. In another aspect of the present disclosure, entrances or apertures leading to the microwave oven that may provide paths for escape of electromagnetic (EM) energy may be equipped with a honeycomb EMI filter having a specific hole pattern to avoid leakage of the EM field out of the microwave oven. When used in conjunction with the electromagnetic barrier, an amount of EMI leakage from the microwave oven may be less than an amount of EMI leakage from conventional microwave ovens.

In another aspect of the present disclosure, the front door covering an opening to the oven cavity may include a door seal that provides EMI shielding within a gap between the oven door and oven cavity as well as an electrical connection between the oven door and oven cavity. In some examples, the door seal may be made from an electrically conductive elastomer, which provides electrical connectivity between the oven door and oven cavity.

Figure 1A:
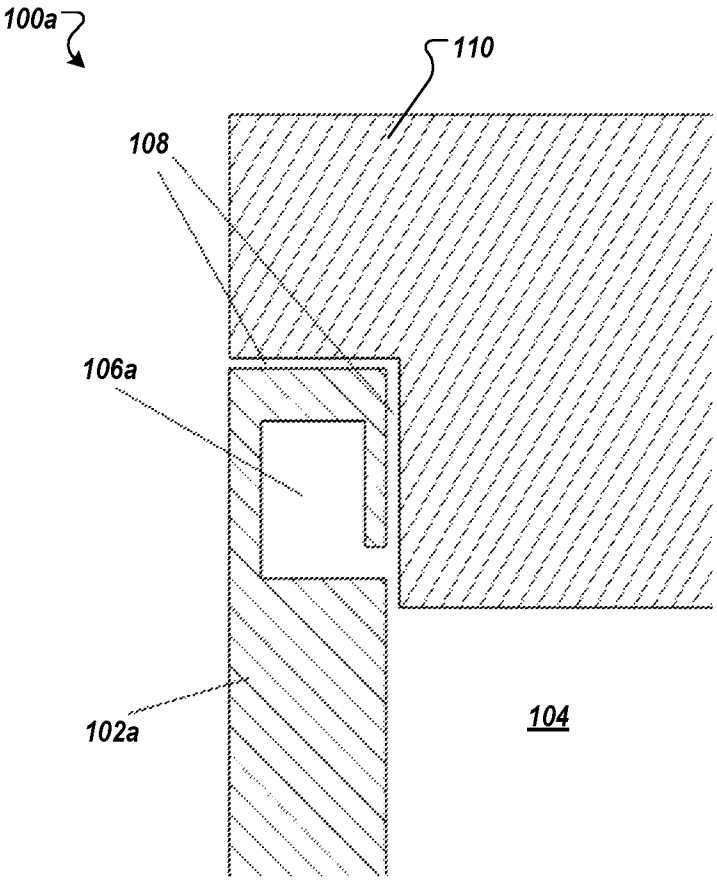

Turning to the figures, FIGS. 1A-1B illustrate cutaway views of a portion of a door 102 and oven cavity 104 for an example aircraft microwave oven 100 including a choke 106 disposed around a periphery of an outer edge of a door 102 to oven cavity 104. The choke 106 may be configured to shield EMI escaping from the oven cavity 104 through a door gap 108 between the door 102 and the oven cavity 104. In some implementations, the door 102 is hingedly mounted on one side of an opening at a front end of an oven housing 110 such that the door 102 is configured to swing in a horizontal plane between open and closed positions.

In some examples, the outer edge of the door 102 that the choke 106 surrounds may be adjacent to the gap 108 at one or more edges of an oven housing 110 surrounding the oven cavity 104 when the door 102 is in a closed position covering an opening to the oven cavity 104 on a front side of the microwave oven 100. FIG. 1A illustrates an implementation of a vertically-oriented choke 106*a*, and FIG. 1B illustrates an implementation of a choke 106*b* that is oriented at an angle from a horizontal plane of the door 102*b*, which may be referred to as inclined choke 106*b* throughout the disclosure.

Figure 2B:
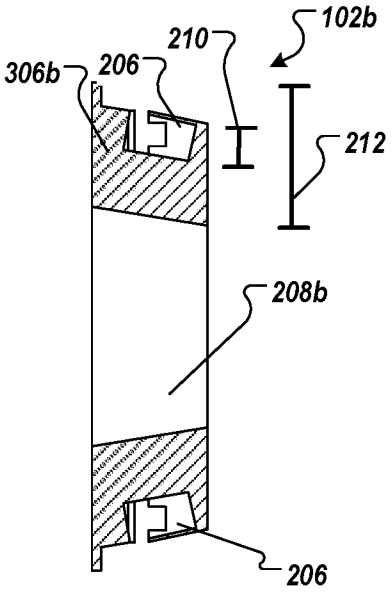
FIGS. 2A-2B illustrate views of an example microwave oven door having an inclined choke.
Figure 2A:
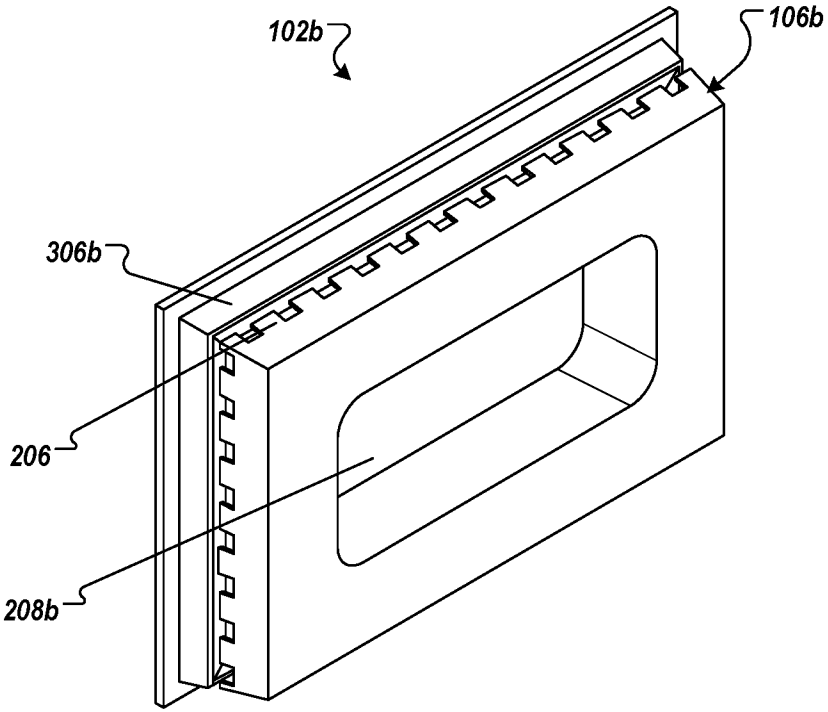

In some examples, the choke 106 surrounding the outer edge of the microwave oven door 102 may be a folded section transformer that has multiple sections having dimensions (e.g., length, width, depth, shape) that are based on a wavelength of the EMI shielded or trapped by the choke 106, such as at least quarter-wavelength sections. FIGS. 2A-2B provide an illustrative example of the inclined choke 106*b* that has multiple choke sections 206 surrounding the outer edge of the microwave oven door 102 that can trap and attenuate the EMI waves that may escape from the oven cavity 104 and into the gap 108 (as illustrated in FIGS. 1A-1B). In some examples, configuring the choke 106 with a horizontal orientation within the door 102 may prevent the door 102 from swinging open. Therefore, the inclined choke 106*b* may be placed at a slightly inclined angle from a horizontal plane.

In some implementations, the outer edge of the door 102 may have a shape that is complementary to the shape and angular orientation of the choke 106 and may also be configured to mate securely with the opening to the microwave oven housing 110 in order to reduce a width of the gap 108, which can further reduce an amount of EMI that may be able to escape from the oven cavity 104. For example, an outer edge of the door 102*b* may oriented at an inclined angle that corresponds to an incline angle of the choke 106*b*. In addition, a thickness of the door 102 may also be based on the shape, dimensions and angular orientation of the choke 106 in which the choke 106 may surround or be disposed within a plane of the door 102 such that the choke 106 may not extend beyond boundaries defined by front, rear, and side edges of the door 102.

In some implementations, the door 102*a* for the vertically-oriented choke 106*a* may be narrower (thinner) than the door 102*b* for the inclined choke 106*b* because the partially horizontal orientation of the inclined choke 106*b* may have a greater horizontal thickness than a thickness of the vertically-oriented choke 106*a*. However, in some implementations, a length of the choke 106 associated with a particular wavelength of radiation corresponds to a quarter wavelength (λ/4) in order to meet aircraft shielding requirements, which may result in an increased length of the vertically-oriented choke 106*a*. Accordingly, a bezel 306*a* (FIG. 3A) that frames an opening 208 of a front surface of the door 102 and forms a counter-shape of the longer vertically-oriented choke 106*a* may be significantly increased due to the increased choke length. For example, the bezel 306*a* may be configured to conceal internal door components, such as the choke 106*a*, from view from outside the microwave oven 100*a*. The increased size of the bezel 306*a* may cause an opening at the front of the microwave oven 100 that provides access to the oven cavity 104 as well as a substantially transparent portion 302*a* (FIG. 3A) of the door 102*a* that allows users to visualize the contents of the oven cavity 104 during use of the microwave oven 100 to be reduced to compensate for the increased length of the choke 106*a*.

In some examples, a thickness of the door 102*b* for the inclined choke 106*b* may be greater than the thickness of the door 102*a* in order to accommodate the greater outward protrusion (horizontal thickness) of the choke 106*b*. For example, the thickness of the door 106*b* may be greater than or equal to a horizontal thickness of the choke 106*b*. By placing the inclined choke 106*b* in a more horizontally-oriented position than the vertically-oriented choke 106*a* within a deeper door, the opening to the oven cavity 104 for the microwave oven 100*b* may be made much bigger as compared to the microwave oven 100*a*. In addition, the substantially transparent portion 302*b* (FIG. 3B) of the door 102*b* that covers the opening of the oven cavity 104 may have a larger area than for the door 102*a* because the inclined choke 106*b* does not take up as much space in the vertical direction as the vertically-oriented choke 106*a*, and a size of the bezel 306*b* for the door 102*b* with the inclined choke 106*b* may be reduced due to the fact that a smaller portion of the choke 106*b* extends within a vertical plane defined by the door 102*b* such that the an area of the choke 106*b* concealed from view from outside the microwave oven 100*b* by the bezel 306*b* is reduced.

Turning FIGS. 2A-2B, views of a door 102*b* for the microwave oven 100*b* having an inclined choke 106*b* are illustrated. For example, FIG. 2A illustrates a rear perspective view of the door 102*b*, and FIG. 2B illustrates a side cross-sectional view of the door 102*b*. In some implementations, the inclined choke 106*b* may include multiple choke sections 206 arranged in a predetermined pattern around an outer edge of at least a rear portion of a door bezel 306*b* that may form a counter-shape for the inclined choke 106*b*. In some examples, the dimensions (e.g., length, width, depth, shape) of the choke sections 206 may be based on an operative wavelength of the EMI waves shielded or trapped by the inclined choke 106*b*. For example, commercial airline regulations may require that the choke sections 206 have a length that corresponds to a quarter-wavelength of the radiation that is shielded by the inclined choke 106*b*. In one example, each of the choke sections 206 may have a substantially square or rectangular shape.

In some implementations, a middle portion of the door 102*b* may include an opening 208*b* surrounded by the bezel 306 that in some examples may be covered by a substantially transparent material such as glass. In some implementations, the dimensions of the opening 208*b* (e.g., length, width, area) may be affected by a height 212 of one side of the bezel 306*b*, which may be affected by a height 210 of the inclined choke 106*b*. For example, because the inclined choke 106*b* may extend a greater distance in a horizontal plane than in a vertical plane, the height 210 of the inclined choke 106*b* may be less than a vertical length of the vertically-oriented choke 106*a* (FIG. 1A). The reduced height 210 of the inclined choke 106*b* may allow the vertical height 212 of the bezel 306*b* to also be reduced, thereby allowing the area of the opening 208*b* to be larger. In some examples, the size of the opening 208*b* may be substantially equal to the size of an opening providing access to a front end of the oven cavity 104, which may allow a volume of the oven cavity 104 to be increased without increasing a total volume of the microwave oven 100.

Figure 3A:
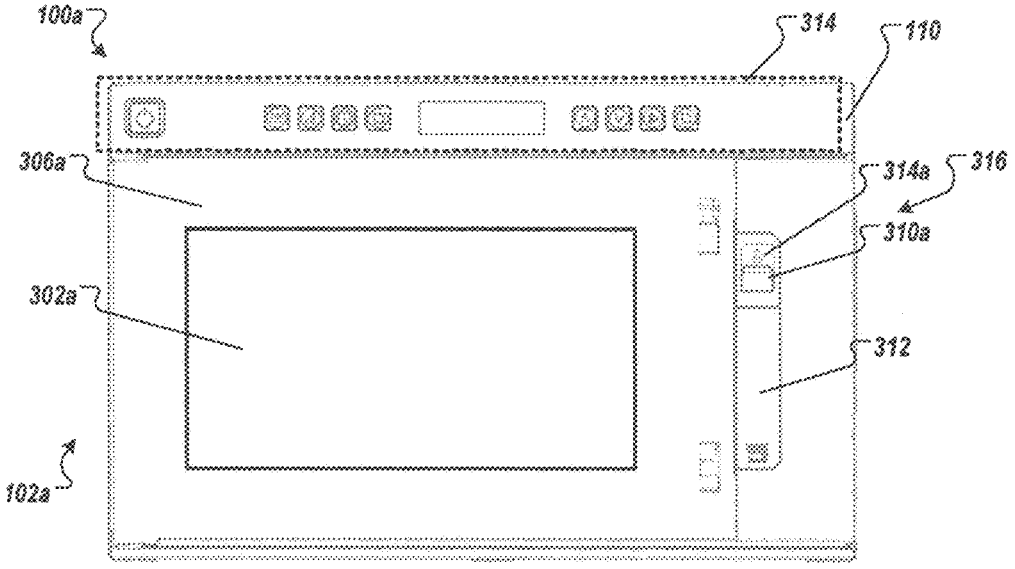
FIGS. 3A-3B illustrate front views of example microwave ovens.
Figure 3B:
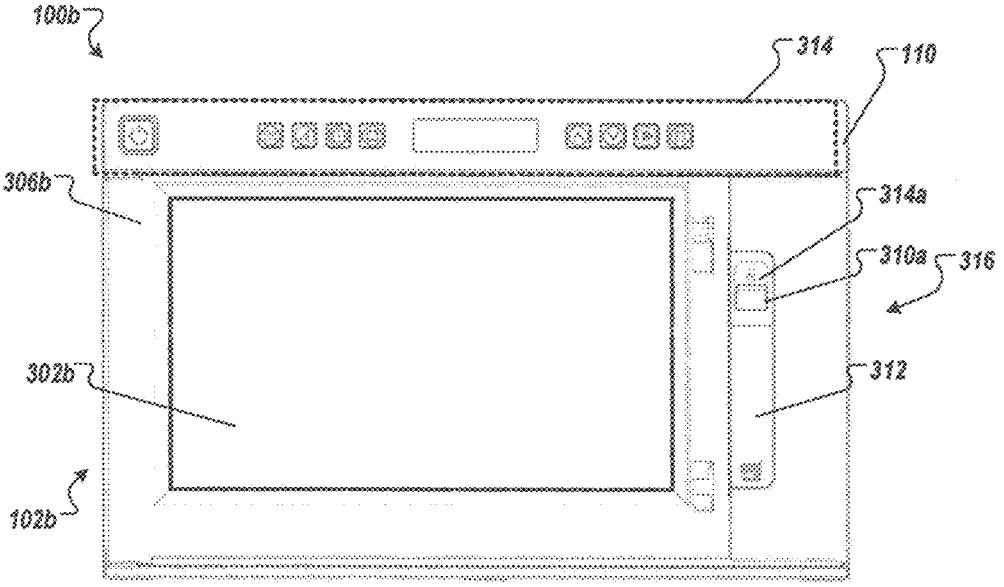

FIGS. 3A-3B illustrate front views of microwave ovens 100 for an aircraft. For example, FIG. 3A illustrates a front view of a microwave oven 100*a* including a door 102*a* with a vertically-oriented choke 106*a*, and FIG. 3B illustrates a front view of a microwave oven 100*b* including a door 102*b* with a horizontally-oriented choke 106*b*. In some implementations, the door 102 may include a bezel 306 that forms a counter-shape for a choke 106 mounted to at least a rear end of the bezel 306 that abuts a front surface of an oven cavity 104 when the door 102 is in a closed position.

In some implementations, bezel 306*a* may form a counter shape of vertically-oriented choke 106*a* (FIG. 1A), which may cover a greater amount of area of a front surface of the door 100*a* than bezel 306*b* for the inclined choke 106*b* due to an increased length of the vertically-oriented choke 106 in a vertical plane, which results in a smaller opening 208*a* for the door 100*a* than the opening 208*b* for the door 100*b* with the inclined choke 106*b*. In some implementations, the opening 208 on the door 102 may be surrounded by the bezel 306 and may cover at least a middle portion of the door 102 to allows users to visualize the contents of the oven cavity 104 during use of the microwave oven 100. In some examples, the inclined choke 106*b* may be physically larger and be able to shield greater wavelengths of EMI than the vertically-oriented choke 106*a* yet still may allow the bezel 306*b* to be a thinner than the bezel 306*a* for the vertically-oriented choke such that the size of the opening 208*b* may be increased.

In some implementations, a front surface of the oven housing 110 may include a control panel 314 with displays and electrical controls, such as pushbuttons, that may allow a user to control and operate the microwave oven 100. In addition, one side of the front surface of the oven housing 110 may include a door latch assembly 316 that allows users to open the door 102 or latch the door 102 in a closed position. In some aspects, the door latch assembly 316 may include a latch 310 that engages the door 102 to lock the door 102 in the closed position to help to ensure a tight seal between the door 102 and the oven housing 110 to prevent EMI waves from escaping from the opening in the front of the oven cavity 104 and into the aircraft cabin. When closing the door 102, a user pushes against a latching force provided by a biasing spring to engage the latch 310, which may cause the latch 310 to move downward to a latched (e.g., lower) position 310*a*. The latch 310 in FIGS. 3A-3B is shown in a latched (e.g., locked) position 310*a* as indicated by a latch position indicator 314. In some examples, the latch position indicator 314 may include icons or colors to indicate whether or not the latch 310 is engaged with the door 102.

For example, the latch position indicator 314 may reveal an icon for a closed lock when the latch 310 is in a latched or engaged condition 314*a*.

Figure 4C:
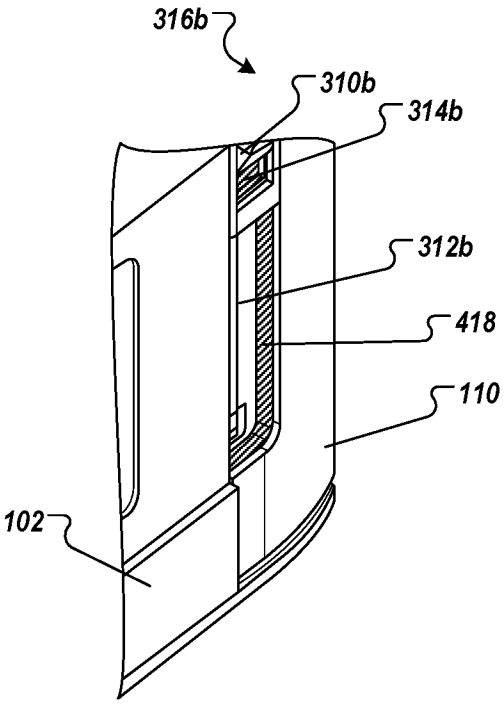
FIGS. 4A-4C illustrate operation of an example microwave oven door latch assembly
Figure 4B:
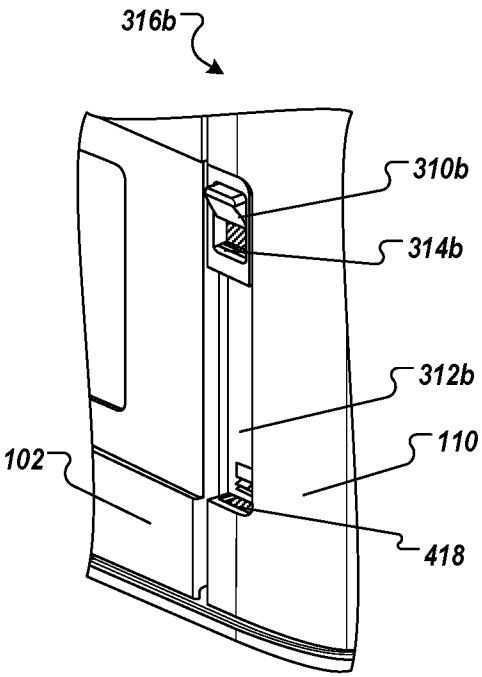
Figure 4A:
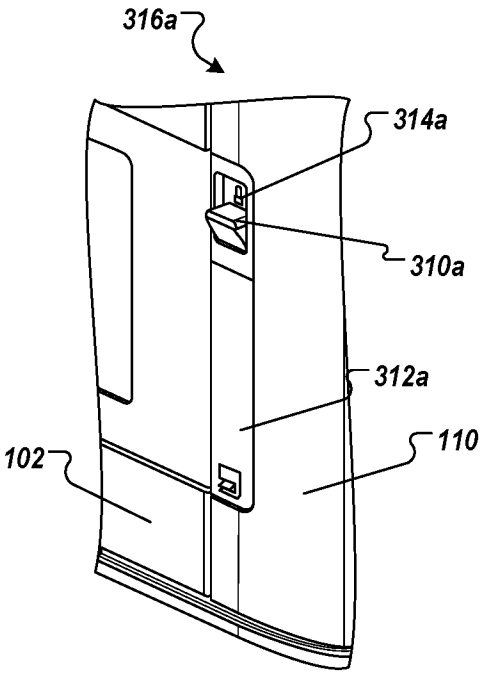

In some examples, the door latch assembly 316 may also include a pushbutton 312 that allows users to unlatch and open the door 102 by depressing the pushbutton 312, which may include additional visual indicators that the door 102 is unlatched and may be at least partially open. FIGS. 4A-4C show views of the door latch assembly 316 for the microwave oven 100 that illustrate the pushbutton 312, latch 310, and latch position indicator 314 in both a latched (e.g., engaged) condition 316*a* and an unlatched (e.g., disengaged) condition 316*b*. For example, FIG. 4A shows the door latch assembly 316 in the latched condition 316*a* in which the latch 310 is in a lowered position 310*a* such that the latch position indicator 314*a* may reveal a particular color or icon to indicate to the user that the door 102 is closed and the latch 310*a* is engaged. In addition, when the latch assembly 316 is in the latched condition 316*a*, the latch 310 may release the pushbutton 310 to an extended position 310*a* such that a front surface the pushbutton 310 may be substantially flush with front surfaces of the door 102 and oven housing 110.

FIGS. 4B-4C illustrate perspective views of the door latch assembly 316 in the unlatched condition 316*b* in which the latch 310 is in a raised position 310*b* such that the latch position indicator 314*b* may expose a particular color or icon to indicate to the user that the door 102 may be at least partially open and the latch 310*b* is disengaged. In some examples, the latch position indicator 314*b* may be a highly visible color such as yellow, orange, or red. In other examples, the latch 310 may have an opposite configuration to that shown in FIGS. 4A-4C such that a lowered position of the latch 310 corresponds to an unlatched condition and a raised position of the latch corresponds to a latched condition for the door latch assembly 316.

In some implementations, a user may depress the pushbutton 312 to a retracted position 312*b*, which may cause the latch 310 to unlatch or release the door 102 as the latch 310 moves to the raised position 310*b*. When the latch 310 releases the door 102, the door 102 may move from a closed position to at least a partially open position as shown in FIGS. 4B and 4C. In addition, the latch 310*b* may retain the pushbutton 312 in the retracted position 312*b* until the door 102 is completely closed, at which time the latch 310 may release the pushbutton 312 to the extended position 312*b*. When the pushbutton 312 is in the retracted position 312*b*, an additional surface 418 of the oven housing 110 may be exposed, which may also have a highly visible color (e.g., yellow, orange, red) to indicate to a user that the door 102 may not be completely closed.

Figure 5:
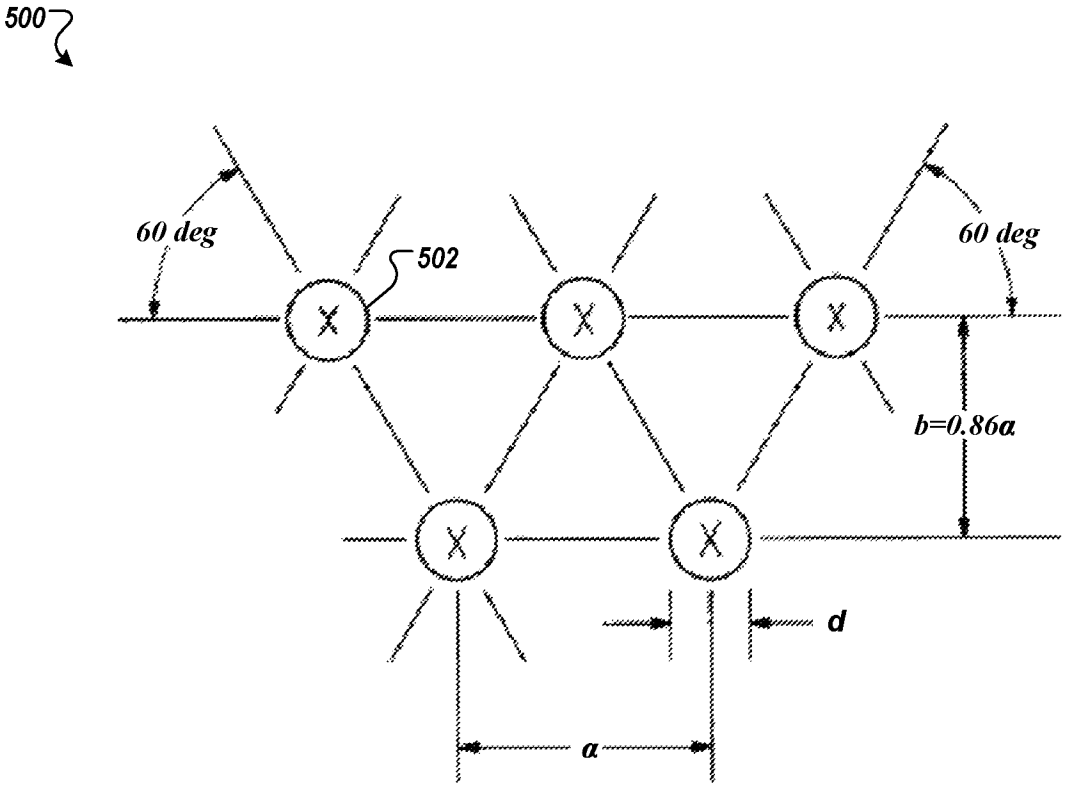
FIG. 5 illustrates an example perforated hole pattern for a substantially transparent shield applied to a door of a microwave oven.

Turning to FIG. 5, a perforated hole pattern 500 for a substantially transparent shield applied to a door of a microwave oven is illustrated. In some implementations, a substantially see-through or translucent EMI shield or barrier made of a metallic sheet material that may be applied to a substantially transparent surface covering the opening 208 (FIG. 2) of the door 102 of the microwave oven 100 (FIGS. 1A-1B) that may include multiple perforated holes or apertures that permit a user to see inside the oven cavity 104 while the microwave oven 100 is in use. In some examples, the substantially see-through or translucent EMI shield may be applied to an interior or exterior surface of the substantially transparent material positioned within the opening 208 of the door 102 such that the oven cavity 104 is visible through the opening 208 in the door 102 from outside the microwave oven 100.

As shown in FIG. 5, the holes 502 perforated hole pattern 500 of the EMI shield may be distributed across the shield with a relationship between the diameters d of the holes 502, a thickness of the metallic sheet, and the pattern distribution of the holes that may be based on desired shielding properties of the electromagnetic shield. In some examples, the holes 502 may be arranged in rows with a first distance a between each of the holes 502 in rows, and each of the rows of holes 502 may be spaced at a second distance b from an adjacent row of holes 502, and the second distance b may correspond to a fraction of the first distance a. In addition, between each row, the holes 502 may be distributed at predetermined angles from one another, such as 60 degrees in one example.

In a preferred embodiment, the EMI shield may be made of a thin photo etched metallic sheet that may provide an improved see-through barrier for a HIRF (High Intensity Radiated Fields) environment, which may not cause arcing due to the small metal edges or shapes of the shield created by the holes 502 perforated pattern 500.

In some examples, the EMI shield may be fabricated through a photoetching process in which a sheet of metal is provided having a thickness of 10, 20, 30, 40, 50, 100, 250, 500, 750, 1000, 1250, 1500, 1750 or 2000 microns (micrometers) or values therebetween. In some aspects, the metallic sheet may be cleaned, and a photosensitive polymer film may be laminated to one or both sides of the raw metallic sheet. In some examples, the laminate may be exposed to UV light through a mask or stencil. The UV light may harden selected areas of the laminate film into acid-resistant surfaces. The sheet may be developed, and any unexposed laminate material may be washed away. In some implementations, acid solution may be sprayed onto the developed laminate material, dissolving areas of exposed metal. The etching process can be performed from one or both sides of the metallic sheet, and any remaining photo-resistant material may be stripped away.

The holes 502 of the EMI shield may, according to this photoetching technique, have diameters of 10, 20, 30, 40, 50, 100, 250, 500, 750, 1000, 1250, 1500, 1750 or 2000 microns (micrometers) or values therebetween. Advantageously, the resulting perforated sheet may be largely devoid of sharp edges or shapes that may promote arcing.

Figure 6B:
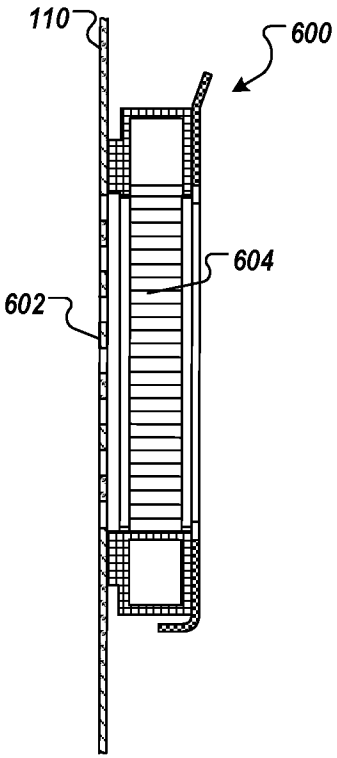
FIGS. 6A-6B illustrate views of an example honeycomb EMI filter for a microwave oven.
Figure 6A:
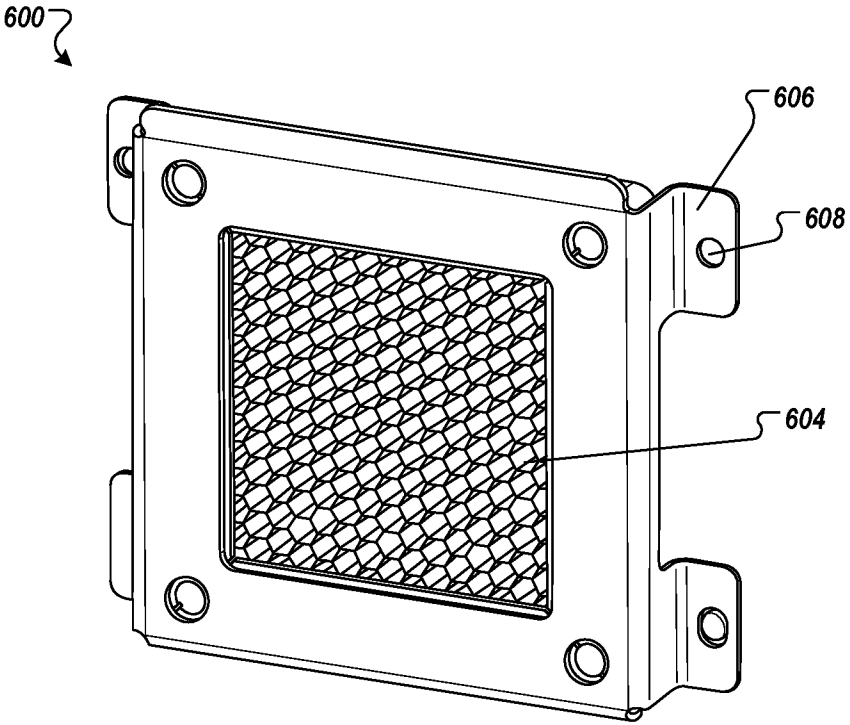

Turning to FIGS. 6A-6B, views of a honeycomb EMI filter 600 for a microwave oven, such as the microwave oven 100 are illustrated. For example, FIG. 6A shows a front perspective view of the EMI filter 600, and FIG. 6B illustrates a side view of the EMI filter 600 mounted to an outer surface of the microwave oven housing 110 that surrounds the oven cavity 104 (FIGS. 1A-1B). In certain embodiments, every entrance or aperture on the leading to the oven cavity or cooking chamber may be equipped with a honeycomb EMI filter 600 having a specific hole pattern 604 and dimensions (e.g., length, width, thickness) to assist in preventing leakage of the EMI field from the oven cavity 104 out into the aircraft cabin or other external space.

For example, the EMI filter 600 shown in FIG. 6B may be mounted to the outer surface of the oven housing 110 such that the EMI filter 600 covers a perforated region 602 of the oven housing 110 that may have gaps or holes 604 that may allow escape of electromagnetic waves from the oven cavity 104. In some examples, the perforated region 602 may be positioned on any surface of the oven housing 110, such as a top, bottom, or side surface. In one example, the EMI filter 600 may be include a mounting bracket 606 with fastener holes 608 that provide for mounting the EMI filter 600 to the outer surface of the oven housing 110.

In some implementations, the photo-etched see-through barrier with the predetermined hole pattern 500 (FIG. 5) described above may be applied to EMI filter 600 to provide additional EMI shielding. When used in conjunction with the photo etched see-through barrier, the resulting microwave oven with EMI filters 600 covering any apertures or perforated regions 602 in the oven housing 110 may exhibit an EMI leakage of 50, 40, 30, 20, 10, 5, 2 or 1 percent of that of a microwave oven equipped with a conventional first barrier and no EMI filters for the remaining apertures or perforated regions.

Figure 7:
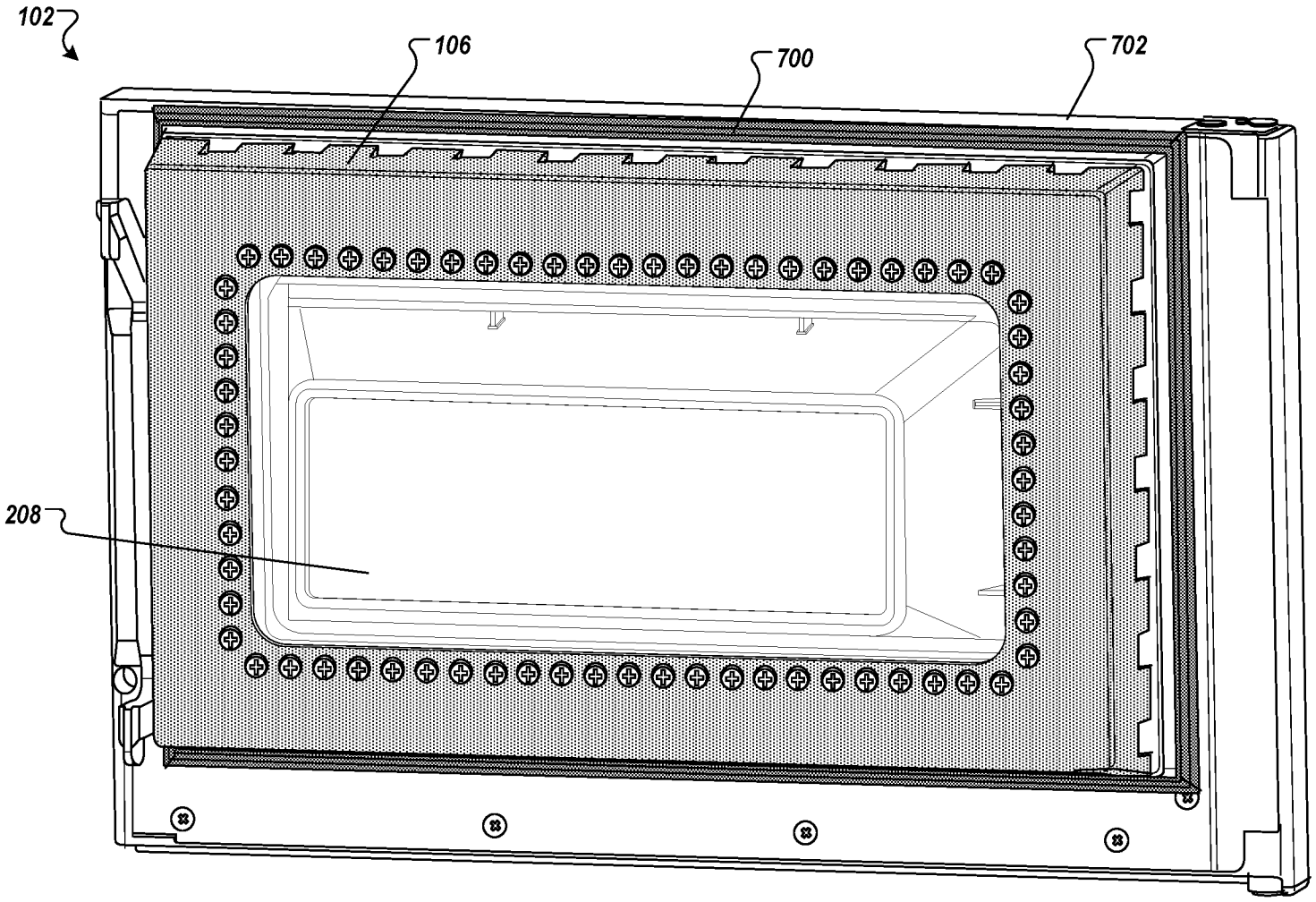
FIG. 7 illustrates a rear perspective view of an example door for a microwave oven.
Figure 8:
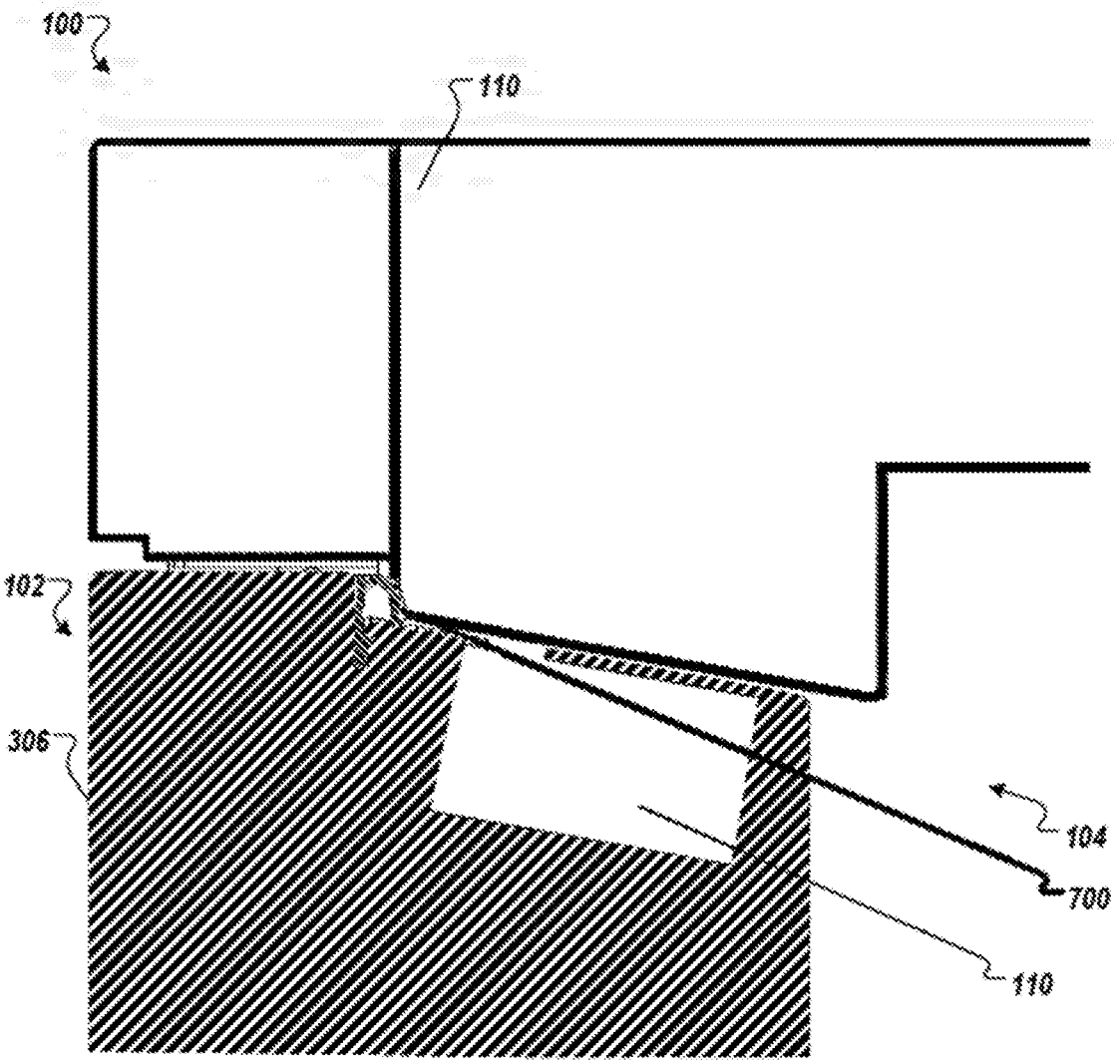
FIG. 8 illustrates a side sectional view of a portion of an example microwave oven.

In certain embodiments, the door 102 for the microwave oven 100 may also include an electrically conductive seal to provide shielding for EMI waves that may enter the gap 108 between the door 102 and the oven housing 110 (FIGS. 1A-1B). For example, FIGS. 7 and 8 show an electrically conductive door seal 700 that may surround a periphery of the door 102. For example, FIG. 7 illustrates a rear perspective view of the door 102 that includes the seal 700, and FIG. 8 illustrates a side sectional view of a portion of the microwave oven 100 in which the door 102 is in a closed position such that the door seal 700 seals off the gap 108 between the door 102 and the oven body 110 to prevent EMI from escaping from the oven cavity, which provides an improvement over conventional microwave oven door seals that do not provide EMI shielding. In some implementations, the door seal 700 may be positioned forward of the choke 106 that is mounted to a rear portion of the door 102 and aft of a front cover 702 for the door 102.

In some implementations, in addition to providing EMI shielding within the gap 108 between the oven door 102 and oven housing 110, the door seal 700 may also provide an electrical connection between the oven door 102 and the oven housing 110 due to the electrically conductive elastomer material that the door seal 700 may be made of that also has sufficient EMI attenuation properties. In addition, the seal 700 may provide a physical seal for containment of fluid and steam inside the oven cavity and may also dampen (in sound and vibration) the impact between the door 102 and the oven housing 110 when the door 102 is closed.

In illustrative embodiments, the door seal 700 may be made from an electrically conductive elastomer made by LAIRD™ having properties specified in TABLE 1 below.

In illustrative embodiments, the electrically conductive door seal 700 may resist opening when pressurized steam builds up within the oven cavity 104. In addition, the pressure differential may allow the seal 700 to close itself off against contaminants (outside the seal 700) when the door 102 is closed, may provide for easy cleaning of the seal 700 without necessitating removal from the oven, and may demonstrate high resistance from damage and abuse.

TABLE 1

| Parameter | ECE126 |
|---|---|
| MIL-DTL-83528C Material Type | Type D |
| Filler | Ag/Al |
| Elastomer | Furorosilicone |
| Color | Tan |
| **Electrical Properties** | |
| Volume Resistivity, Ω cm, max | 0.01 |
| Shielding Eff, 10 GHz, dB, min | 100 |
| **Physical Properties** | |
| Density, g/cm$^3$ (+/−0.25) | 2 |
| Hardness, Shore A (+/−7) | 70 |
| Tensile Strength, psi, min | 200 |

TABLE 1-continued

| Parameter | ECE126 |
|---|---|
| Elongation | 60-260% |
| Tear Strength, ppi, min | 35 |
| Compression Set, max | 30% |
| Compression/Deflection, %, min | 3.5 |
| Max Operating Temp., ° C. | 160 |
| Min Operating Temp., ° C. | −55 |
| Flame Retardance | V0 |
| Fluid Immersion | Survivable |
| **Electrical Stability** | |
| After Heat Aging, Ω cm, max | 0.015 |
| After Break, Ω cm, max | 0.015 |
| During Vibration, Ω cm, max | 0.015 |
| After Exposure to EMP, Ω cm, max | 0.015 |

While certain embodiments have been described, these embodiments have been presented by way of example only, and are not intended to limit the scope of the present disclosures. Indeed, the novel methods, apparatuses and systems described herein can be embodied in a variety of other forms; furthermore, various omissions, substitutions and changes in the form of the methods, apparatuses and systems described herein can be made without departing from the spirit of the present disclosures. The accompanying claims and their equivalents are intended to cover such forms or modifications as would fall within the scope and spirit of the present disclosures.

What is claimed is:

1. A door assembly for an aircraft galley microwave oven, the door assembly comprising:

a door hingedly mounted to a front end of a microwave oven housing, wherein the door is configured to cover an opening at the front end that provides access to an interior portion of the microwave oven, the door including a bezel forming an outer frame of the door, the bezel configured to conceal internal door components from view from outside the microwave oven, and an inner door portion disposed within the bezel, the inner door portion made of a substantially transparent material and having an area that corresponds to the opening;

and an electromagnetic interference (EMI) attenuation device disposed around one or more outer edges of the door, the EMI attenuation device including a plurality of folded transformer sections having dimensions based on an operative wavelength of electromagnetic energy generated by the microwave oven, wherein the EMI attenuation device is configured to attenuate EMI waves escaping to an external environment from the interior portion of the microwave oven through a gap between the microwave oven housing and the door, and each of the plurality of folded transformer sections is positioned at an incline angle from a horizontal plane such that each of the plurality of folded transformer sections extends a greater distance in the horizontal plane than in a vertical plane.

2. The door assembly of claim 1, wherein each of the plurality of folded transformer sections has a depth that corresponds to at least a quarter of the operative wavelength of the electromagnetic energy generated by the microwave oven.

3. The door assembly of claim 1, wherein the one or more outer edges of the door are oriented at an angle that corresponds to the incline angle from the horizontal plane of each of the plurality of folded transformer sections.

4. The door assembly of claim 1, wherein a thickness of the door is greater than or equal to a horizontal thickness of each of the plurality of folded transformer sections.

5. The door assembly of claim 1, further comprising a seal surrounding the one or more outer edges of the door, the seal positioned forward of the EMI attenuation device and configured to further attenuate the EMI waves escaping to the external environment from the interior portion of the microwave oven through the gap between the microwave oven housing and the door.

6. The door assembly of claim 5, wherein the seal is made of an electrically conductive elastomer material such that the seal provides an electrical connection between the door and the microwave oven housing.

7. The door assembly of claim 1, further comprising a photo-etched metallic sheet applied to a surface of the substantially transparent material of the inner door portion, wherein the photo-etched metallic sheet is configured to provide electromagnetic shielding for the EMI waves escaping to the external environment from the interior portion of the microwave oven.

8. The door assembly of claim 7, wherein the photo-etched metallic sheet is applied to an interior surface of the substantially transparent material of the inner door portion.

9. The door assembly of claim 7, wherein the photo-etched metallic sheet includes a plurality of perforations disposed across a surface of the metallic sheet in a predetermined pattern, wherein the predetermined pattern and size of the plurality of perforations are based on electromagnetic shielding properties of the metallic sheet.

10. The door assembly of claim 7, wherein the photo-etched metallic sheet applied to the inner door portion is substantially see-through such that the interior portion of the microwave oven is visible through the inner door portion from outside the microwave oven.

11. A microwave oven for an aircraft galley comprising:

an enclosure configured to house and heat an item to be heated with microwave radiation, the enclosure comprising a rear surface, an upper wall, opposing side walls, and an opening at a front surface of the enclosure, the front surface opposite the rear surface;

and a door assembly comprising a door hingedly mounted to an edge of the opening and configured to cover the opening, the door including a bezel forming an outer frame of the door, the bezel configured to conceal internal door components from view from outside the oven, and an inner door portion disposed within the bezel, the inner door portion made of a substantially transparent material and having an area that corresponds to the opening, and an electromagnetic interference (EMI) attenuation device disposed around one or more outer edges of the door, the EMI attenuation device including a plurality of folded transformer sections having dimensions based on an operative wavelength of electromagnetic energy generated by the oven, wherein the EMI attenuation device is configured to attenuate EMI waves escaping to an external environment from within the enclosure through a gap between the enclosure and the door, and each of the plurality of folded transformer sections is positioned at an incline angle from a horizontal plane such that each of the plurality of folded transformer sections extends a greater distance in the horizontal plane than in a vertical plane.

12. The microwave oven of claim 11, wherein each of the plurality of folded transformer sections has a depth that corresponds to at least a quarter of the operative wavelength of the electromagnetic energy generated by the microwave oven.

13. The microwave oven of claim 11, wherein the one or more outer edges of the door are oriented at an angle that corresponds to the incline angle from the horizontal plane of each of the plurality of folded transformer sections.

14. The microwave oven of claim 11, wherein a thickness of the door is greater than or equal to a horizontal thickness of each of the plurality of folded transformer sections.

15. The microwave oven of claim 11, further comprising a seal surrounding the one or more outer edges of the door, the seal positioned forward of the EMI attenuation device and configured to further attenuate the EMI waves escaping to the external environment from within the enclosure through the gap between the enclosure and the door.

16. The microwave oven of claim 15, wherein the seal is made of an electrically conductive elastomer material such that the seal provides an electrical connection between the door and the enclosure.

17. The microwave oven of claim 11, further comprising a photo-etched metallic sheet applied to a surface of the substantially transparent material of the inner door portion, wherein the photo-etched metallic sheet is configured to provide electromagnetic shielding for the EMI waves escaping to the external environment from within the enclosure.

18. The microwave oven of claim 17, wherein the photo-etched metallic sheet is applied to an interior surface of the substantially transparent material of the inner door portion.

19. The microwave oven of claim 17, wherein the photo-etched metallic sheet includes a plurality of perforations disposed across a surface of the metallic sheet in a predetermined pattern, wherein the predetermined pattern and size of the plurality of perforations are based on electromagnetic shielding properties of the metallic sheet.

20. The microwave oven of claim 17, wherein the photo-etched metallic sheet applied to the inner door portion is substantially see-through such that an interior portion of the enclosure is visible through the inner door portion from outside the microwave oven.

* * * * *